United States Patent [19]

Nickason et al.

[11] Patent Number: 4,872,491

[45] Date of Patent: Oct. 10, 1989

[54] RECOVERY OF PROPELLANT FROM AEROSOL CAN FILLING OPERATION

[75] Inventors: Barry E. Nickason, Scarborough; Orazio DiGirolamo, Weston, both of Canada

[73] Assignee: CCL Industries Inc., Willowdale, Canada

[21] Appl. No.: 189,946

[22] Filed: May 3, 1988

[51] Int. Cl.[4] ..... B65B 3/04; B65B 31/00

[52] U.S. Cl. ..... 141/20; 141/89; 141/104; 141/105; 141/244; 137/597; 222/148

[58] Field of Search ..... 141/9, 3, 200, 85, 237, 141/242, 244

[56] References Cited

U.S. PATENT DOCUMENTS

| | | | |
|---|---|---|---|
| 3,211,191 | 10/1965 | Honisch | 141/20 |
| 3,604,477 | 9/1971 | Grothoff | 141/20 |
| 3,750,687 | 8/1973 | Williams | 137/597 X |
| 3,797,534 | 3/1974 | Skidmore | 141/3 |
| 4,136,719 | 1/1979 | Kronseder et al. | 141/91 X |
| 4,171,710 | 10/1979 | Boynton et al. | 141/91 X |
| 4,582,226 | 4/1986 | Doak | 222/148 |

*Primary Examiner*—Ernest G. Cusick

*Attorney, Agent, or Firm*—Sim & McBurney

[57] ABSTRACT

A system is described for changing over propellant feeds to an aerosol can filling operation and for servicing filling heads without venting propellant to atmosphere. Instead, the propellant is collected in a scrap salvage tank.

4 Claims, 7 Drawing Sheets

RECOVERY OF PROPELLANT FROM AEROSOL CAN FILLING OPERATION

FIELD OF INVENTION

The present invention relates to a method of filling aerosol cans and, in particular, to an operation to recover excess propellant conventionally vented to atmosphere.

BACKGROUND TO THE INVENTION

Aerosol containers or cans for a variety of active components are charged with propellant. Usually, a plurality of filling lines is provided to charge the cans with one of a number of possible propellant compositions.

It is often necessary to change over from a feed of one propellant to feed of another propellant as the active component changes in the containers to be charged. When such a changeover is made, there is inevitably a quantity of the first propellant present in the feed line. Conventionally, this residual amount of first propellant is vented to atmosphere.

With increasingly-stringent restrictions on atmospheric emissions, increasing pressure has arisen to avoid venting propellant. The aim of the present invention is to avoid such venting while, at the same time, retaining an efficient propellant filling operation.

SUMMARY OF INVENTION

In accordance with the present invention, the feed lines and the gassification device are connected to a scrap salvage tank to which quantities of one blend of propellant left therein on a changeover of propellant blend is discharged.

The present invention includes a novel method of switching over from one propellant to another without venting propellant to atmosphere. In accordance with one aspect of the invention, there is provided an improvement in a method of charging aerosol cans with propellant wherein at least two different propellant blends are selectively connected to an aerosol can charging operation. The improvement involves expelling propellant of one blend present in propellant feed lines and propellant charging device by propellant of another blend during changeover from charging one blend to charging another blend and collecting the expelled one propellant in an enclosed space.

Further, the present invention includes a novel propellant feed and recovery system. In accordance with another aspect of the invention, there is provided a system for charging aerosol spray cans with propellant, comprising a first supply tank for housing a first blend of propellant; a second supply tank for housing a second blend of propellant; a scrap salvage tank for receiving propellant; a multiple head aerosol can propellant charging device; a propellant feed line connected to a supply manifold for selectively connecting the propellant feed line to one of the supply tanks; pump means in the feed line for pumping liquid propellant to the charging device; a first propellant return line connected between the feed line and a return manifold for selectively connecting the return line to one of the supply tanks or to the scrap salvage tank; and a second propellant return line connected between the charging device and the scrap salvage tank.

The present invention further includes a modified gassification device. In accordance with a further aspect of the present invention, there is provided an improvement in a multiple head propellant charging device wherein each head is connected to a propellant supply manifold through a first feed line having a selectively-actuable on-off valve, a metering cylinder and a second feed line. The improvement comprises, for each head, a third feed line connected between the first feed line upstream of the on-off valve and a discharge manifold and a second selectively-actuable on-off valve in the third feed line.

DESCRIPTION OF PREFERRED EMBODIMENT

Figure 1:
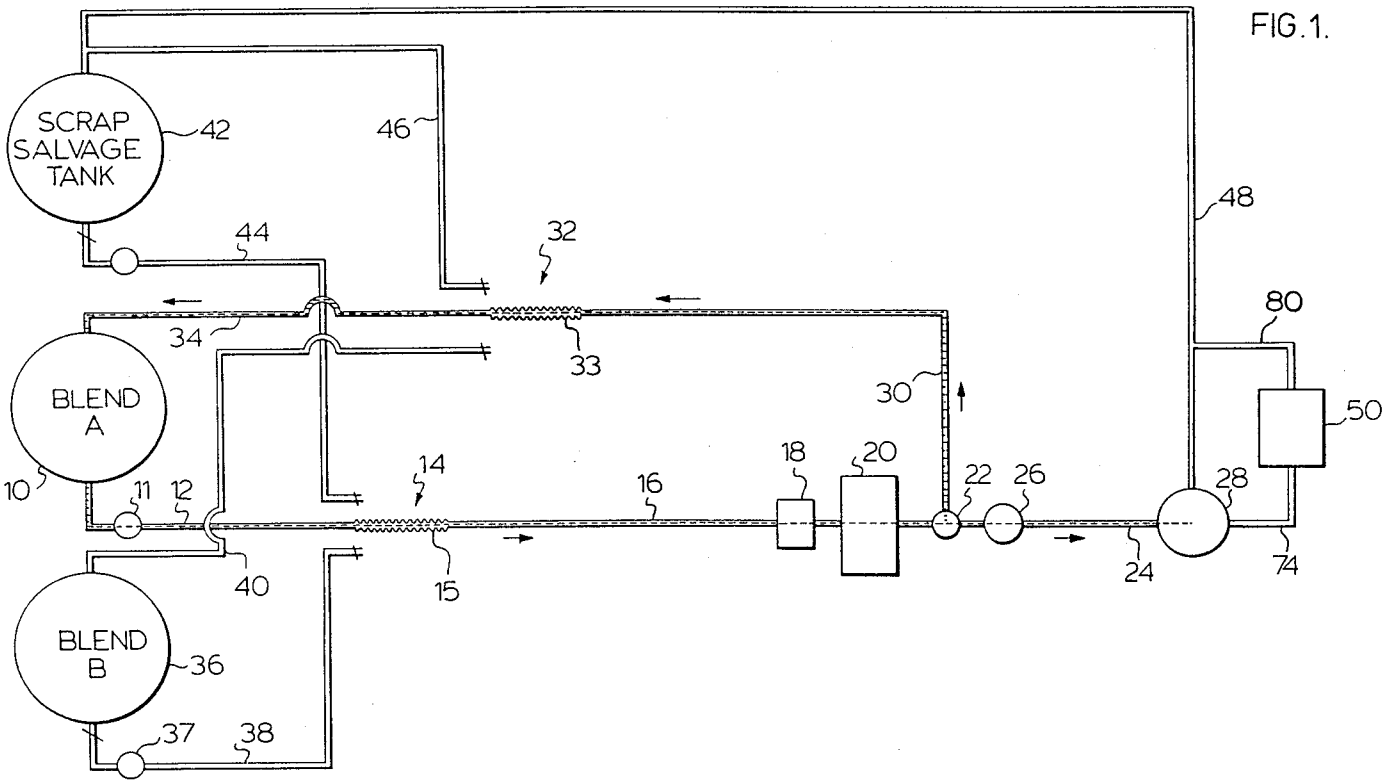
FIG. 1 is a schematic flow sheet of a propellant charging and reclamation system provided in accordance with one embodiment of the invention during normal charging with a first propellant blend.

Referring to the drawings, there is illustrated in FIGS. 1 to 4 one embodiment of the system of the invention wherein one propellant charging line is illustrated as being alternately fed with two propellant blends. It will be understood that the principles set forth herein are applicable to charging any desired number of blends to any desired number of charging lines.

Propellant blend A is fed from a storage tank 10 by a pump 11 through line 12 to a supply manifold 14. With the downstream side of the supply manifold 14 connected to the line 12 through a connecting hose 15, as shown in FIG. 1, propellant blend A passes by line 16 via a heat exchanger 18 and triplex pump 20 to a regulator 22.

From the regulator 22, the required quantity of propellant desired to be charged to the propellant can is passed by line 24 via an accumulator 26 to a gassification device 28, details of which are described below with respect to FIG. 4. Propellant not forwarded by line 24 to the gassification device 28 is recycled by line 30, through return manifold 32 via a connecting hose 33 and line 34 to the blend A storage tank 10.

Also included in the propellant charging and reclamation system are a propellant blend B storage tank 36 connected by lines 38 and 40 respectively to the supply manifold 14 and the return manifold 32 for selective connection therethrough to feed line 16 and return line 30. In addition, the system also includes a scrap salvage tank 42 connected by lines 44 and 46 respectively to the supply manifold 14 and the return manifold 32 for selective connection therethrough to feed line 16 and return line 30.

Also connected to the scrap salvage tank 42 is a line 48 which is joined directly to the gassification device 28 and also indirectly to the charge device through a reclaim unit 50 connected to the gassification device 28.

Figure 3:
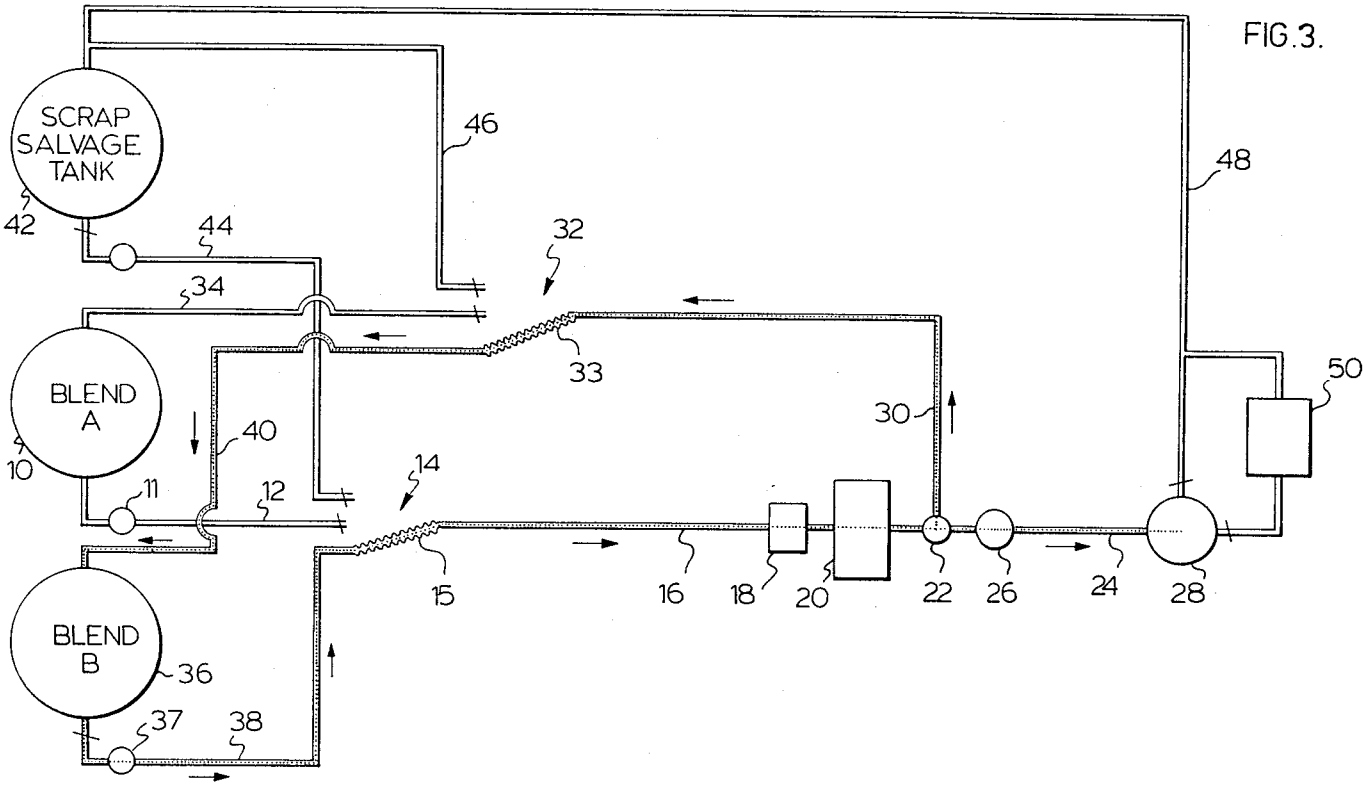
FIG. 3 is a schematic flow sheet of the system of FIG. 1 during normal charging with the second propellant blend.
Figure 4:
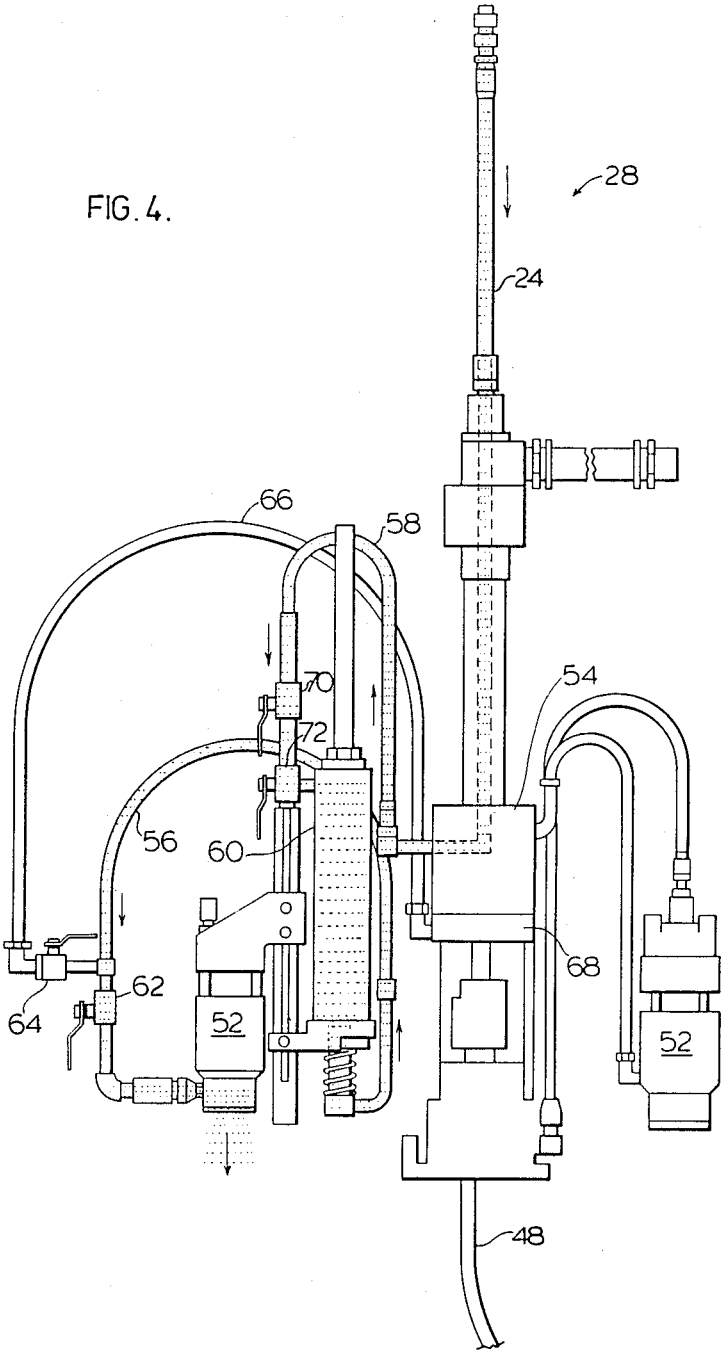
FIG. 4 is a detail view of a propellant charging device used in the system of FIG. 1 during normal charging by a propellant blend.

Normal operation using propellant blend A as shown in FIGS. 1 and 4 continues until it is desired to switch to a feed of propellant blend B to the gassification device 28. The steps involved in the changeover are described with reference to the schematic illustrations of FIGS. 2 and 3. The gassification device 28 first is stopped and then the triplex pump 20 and blend A feed pump 11. A valve in the feed line 12 is closed off at the supply manifold 14 and the connecting hose 15 is bled, separated from line 12 and then is connected to feed line 38 from propellant B tank 36.

Similarly, the valve in return line 34 is closed off at the return manifold 32 and the connecting hose 33 is bled, separated from line 34 and connected to return line 46 to the scrap salvage tank 42. Valves in lines 38 and 40 are opened to establish communication respectively through supply manifold 14 to line 16 and through return manifold 32 to line 30.

Figure 2:
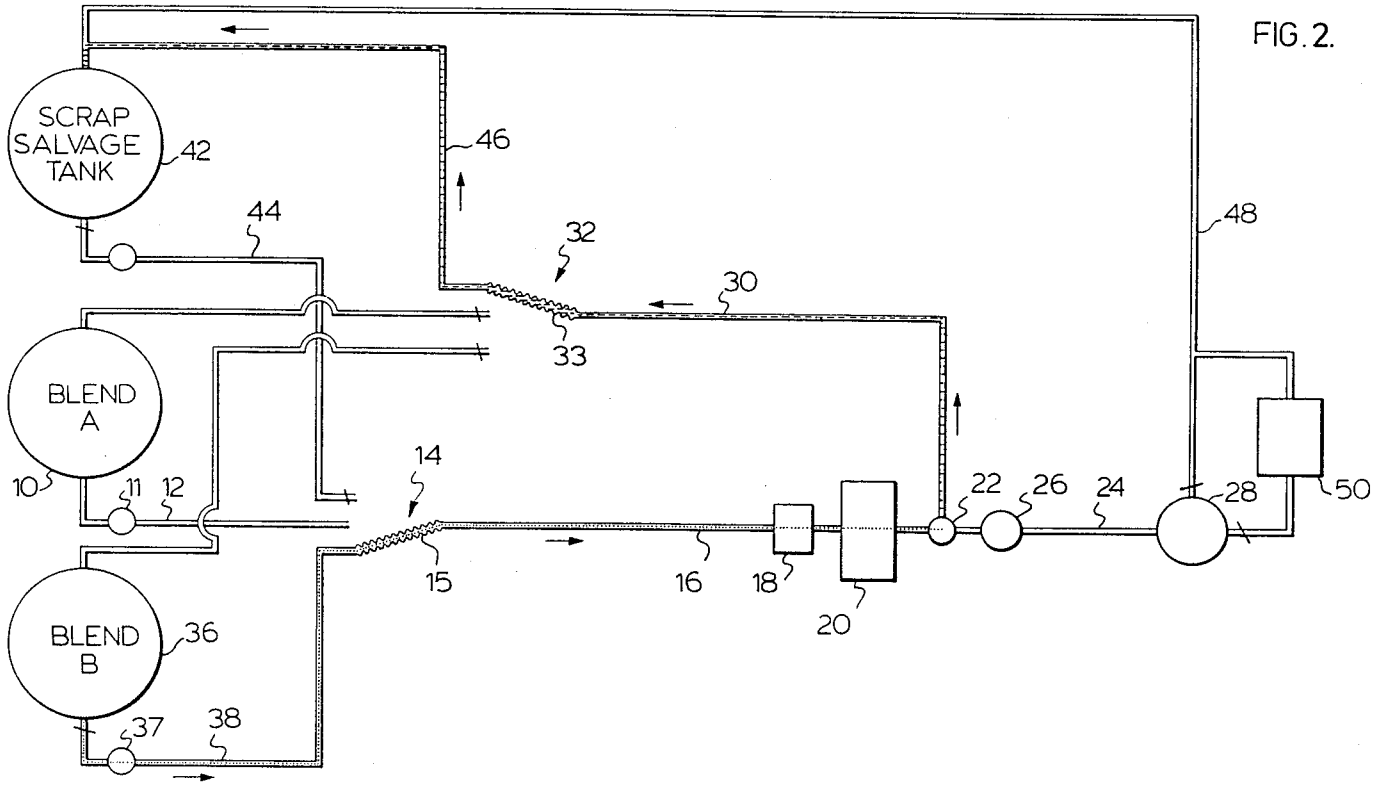
FIG. 2 is a schematic flow sheet of the system of FIG. 1 at one stage of changeover from a first propellant blend to a second propellant blend.

The supply pump 37 from blend B supply tank 36 then is turned on as is the triplex pump 20. Flow of blend B then proceeds through lines 16 and 30 through the manifold 32 to the scrap salvage tank 42, thereby clearing lines 16 and 30 of blend A. This intermediate phase of operation is seen in FIG. 2.

The triplex pump 20 is again turned off. The valves at the return manifold 32 are closed off and the hose 33 is bled and disconnected. The hose 33 then is connected to the return line 40 and the valves at the return manifold 32 are opened. The triplex pump 20 is turned on and the propellant blend B then recirculates between the storage tank 36.

There remains to be cleared the blend A propellant in line 24 and in the gassification device 28. As seen in its normal operation in FIG. 4, the gassification device 28 comprises a plurality of gassification heads 52 connected through a manifold 54 to the propellant supply line 24.

The head 52 is connected to the manifold 54 by pipes 56 and 58 and cylinder 60. Pipe 56 is provided with a shut-off valve 62 adjacent the head 52. The pipe 56 is tapped upstream of the valve 62 and this tap is joined through shut-off valve 64 to pipe 66 which is connected to a reclaim or discharge manifold 68 which, in turn, is joined to line 48.

Figure 5:
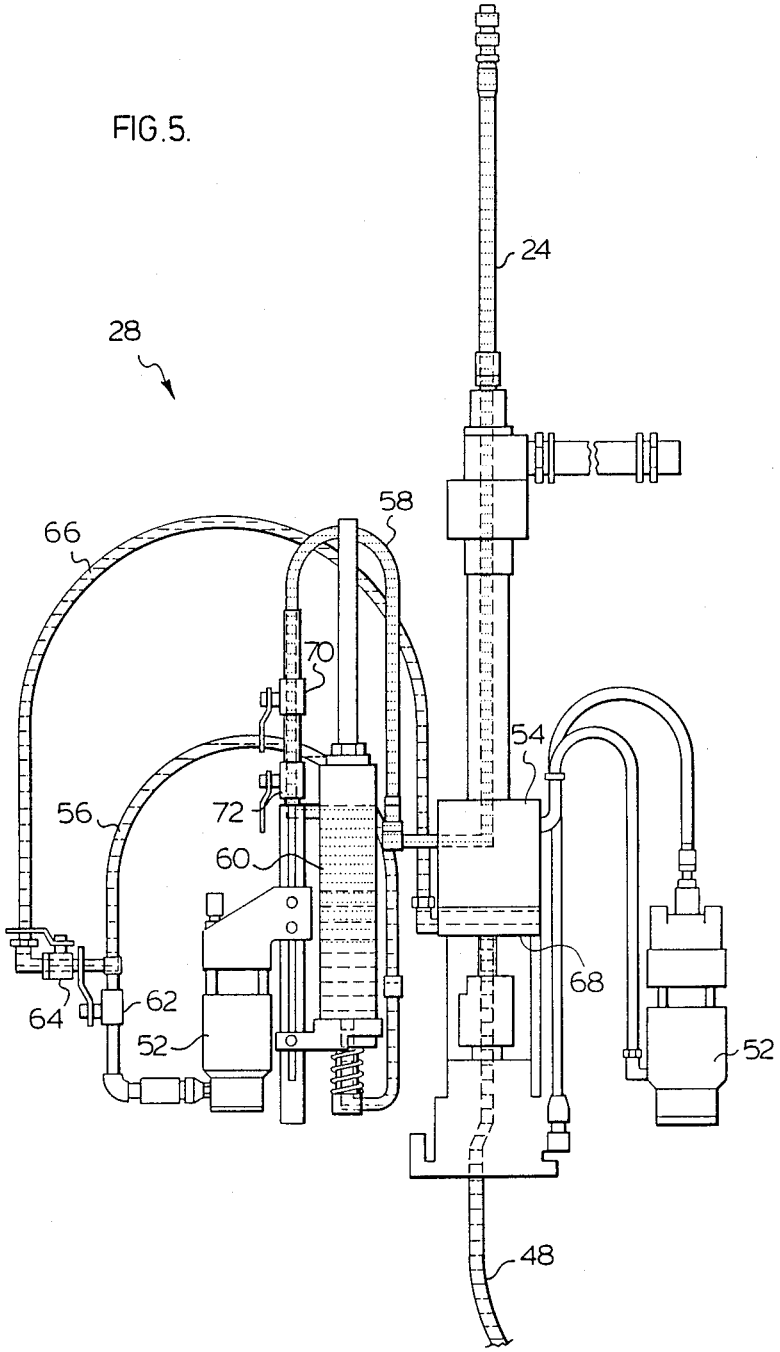
FIG. 5 is a detail view of the propellant charging device of FIG. 4 during changeover from one propellant blend to another.

To clear the blend A propellant from line 24 and from the gassification device 28, the valves 62 associated with each gassification head 52 are closed and each valve 64 is opened. The gassification device 28 then is operated in a no-can/no-fill mode, which is achieved by manually-actuating the no-can/no-fill pins on the machine as the heads rotate. Propellant blend B, under the influence of the triplex pump 20, then passes through line 24 and, successively for each head 52, purges blend A from lines 56 and 58 and cylinder 60 through lines 66 to the reclaim manifold 68. The purged blend A then is expelled from the gassification device 28 through line 48 to the scrap salvage tank 42. This phase of operation is shown in FIG. 5.

When the purging of blend A is finished, valves 64 are closed and valves 62 reopened, whereupon the changeover from blend A propellant to blend B propellant is complete and normal fillig operation with blend B propellant can take place, as shown in FIG. 3. Operation of the gassification device reverts to that illustrated in FIG. 4.

No propellant is allowed to escape with the system described above with respect to FIGS. 1 to 5, and, during a changeover from one blend to another, residual propellant of one blend is vented to a scrap salvage tank 42 and not to atmosphere. The changeover is efficiently effected without any danger of environmental damage. The sump of propellant collected in the tank 42 may be processed to recover the components or disposed of.

It is sometimes necessary to evacuate the gassification device 28 completely of propellant for servicing of one or more of the cylinders 60, and, again, this is achieved without venting any propellant to atmosphere. Joining feed line 58 to the metering cylinder 60 are two shut-off valves 70 and 72. When it is desired to evacuate a cylinder 60 of the device 28, valves 62, 70 and 72 are closed and pipe 58 is disconnected from cylinder 60 at the join of the valves 70 and 72.

Figure 6:
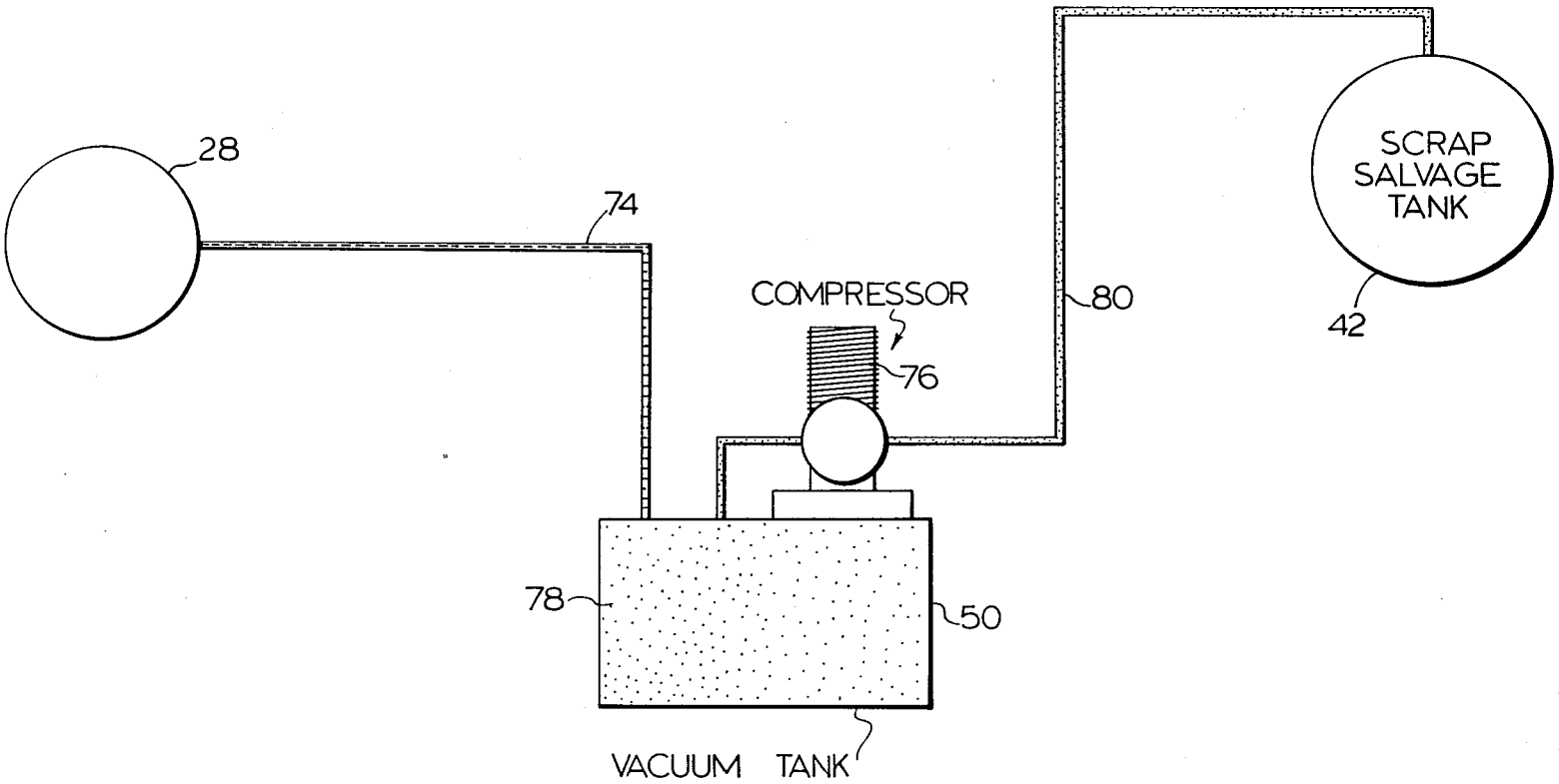
FIG. 6 is a schematic of a portion only of the flow sheet of FIG. 1 connected during servicing of the metering cylinder.
Figure 7:
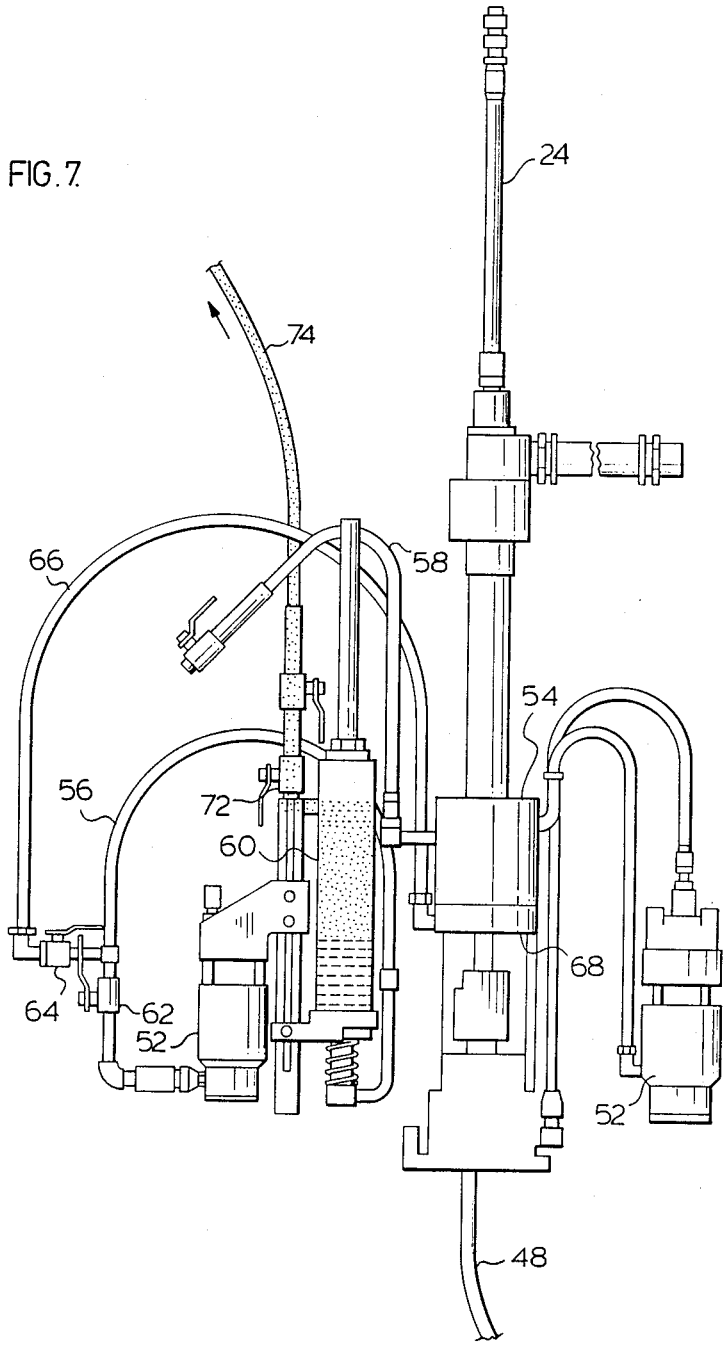
FIG. 7 is a detail view of the propellant charging device of FIG. 4 connected for servicing of the metering cylinder.

An evacuation line 74 from the reclaim unit 50 then is connected to valve 72 and valve 72 is reopened. The reclaim unit 50 includes a compressor 76 (see FIG. 6) which pulls a vacuum on an accumulator or vacuum tank 78 for propellant. As the liquid propellant is drawn from the cylinder 60 through valve 72 and line 74 by the vacuum, it evaporates and expands in volume in the accumulator 78 and accordingly decreases the vacuum.

The compressor 76 continues to evacuate the accumulator 78 and the vacuum eventually is reestablished for the next service requirement. As the vacuum is reestablished by the compressor 76, the propellant is compressed back to the liquid state as it is pumped via lines 80 and 48 to the scrap salvage tank 42.

Following servicing of the cylinder 60, the connection between line 58 and the cylinder 60 is reestablished and the valves 70 and 62 are reopened to recommence normal propellant flow to the filling head 52, as seen in FIG. 4.

SUMMARY OF DISCLOSURE

In summary of this disclosure, the present invention provides a novel propellant feeding system which enables changeover from one blend to another and also servicing to be effected without venting propellant to atmosphere. Modifications are possible within the scope of this invention.

What we claim is:

1. A system for charging aerosol spray cans with propellant, comprising:

a first supply tank for housing a first blend of propellant, a second supply tank for housing a second blend of propellant, a scrap salvage tank for receiving propellant, a multiple head aerosol can propellant charging device, a propellant supply manifold, a propellant feed line connected between said propellant supply manifold and said multiple head aerosol can propellant charging device, said supply manifold being selectively connected to one of said supply tanks, whereby liquid propellant may be fed from a selected one of said supply tanks through said supply manifold and said propellant feed line to said charging device.

pump means in said propellant feed line for pumping liquid propellant from said selected one of said supply tanks to said charging device, a return manifold, a first propellant return line connected between said propellant feed line and said return manifold, said return manifold selectively connecting said first propellant return line to a selected one of said supply tanks or to said scrap salvage tank, whereby liquid propellant in said propellant feed line not passing to said charging device is recycled by said first propellant feed or to said scrap salvage tank, and a second propellant return line connected between said charging device and said scrap salvage tank for discharging propellant from said charging device to said scrap salvage tank.

2. The system of claim 1 wherein said multiple head charging device has a multiple number of heads, a charging device propellant supply manifold connected to said propellant feed line and a charging device propellant discharge manifold connected to said second propellant return line, each said head is connected to said charging device propellant supply manifold through a first charging device propellant feed line having a first charging device selectively-actuable on-off valve, a charging device propellant metering cylinder and a second charging device propellant feed line, whereby propellant may be fed from said propellant feed line to each said head through said first charging device propellant feed line, said first charging device on-off valve and said second charging device propellant feed line, and each said head is connected to said charging device propellant discharge manifold through a third propellant feed line upstream of said first charging device on-off valve, said third charging device propellant feed line having a second charging device selectively-actuable on-off valve therein, whereby said propellant may be discharged from each said head through said third charging device propellant feed line to said second propellant return line.

3. The system of claim 2 wherein said second feed line has third and fourth selectively-actuable on-off valves joined one to another and located at said metering cylinder.

4. The system of claim 3 wherein a vacuum tank is provided for selective joining to said fourth selectively-actuable on-off valve when disconnected from said third such on-off valve, a compressor is provided in association with said vacuum tank for providing a vacuum in said vacuum tank and for compressing propellant vapor received in said vacuum tank from said metering cylinder, and a third propellant return line connected between said compressor and said scrap salvage tank whereby propellant compound in said compressor may be discharged to the scrap salvage tank.

* * * * *